US005568702A

United States Patent [19]

Frank et al.

[11] Patent Number: 5,568,702

[45] Date of Patent: Oct. 29, 1996

[54] VENT AND TILT ROOF WINDOW

[75] Inventors: Karl-Heinz Frank, Waldenbuch; Johann Schneider; Volker Wöhrn, both of Leinfelden-Echterdingen, all of Germany

[73] Assignee: Roto Frank AG, Leinfelden-Echterdingen, Germany

[21] Appl. No.: 429,123

[22] Filed: Apr. 26, 1995

[30] Foreign Application Priority Data

Apr. 26, 1994 [DE] Germany ..... 9406930 U

[51] Int. Cl.[6] ..... E05D 15/48

[52] U.S. Cl. ..... 49/153; 49/192; 49/253

[58] Field of Search ..... 49/386, 192, 153, 49/246, 250, 253, 252, 261, 390; 52/72

[56] References Cited

U.S. PATENT DOCUMENTS 4,055,024 10/1977 Frank ..... 49/192 X
4,480,406 11/1984 Frank ..... 49/153
4,486,978 12/1984 Frank ..... 49/192 X
4,602,457 7/1986 Kreusel ..... 49/192

FOREIGN PATENT DOCUMENTS 2414887 10/1974 Germany .
2708785 10/1978 Germany .

*Primary Examiner*—Philip C. Kannan
*Attorney, Agent, or Firm*—Pepe & Hazard

[57] ABSTRACT

The invention concerns a hinged, swinging skylight in which the sash can rotate and is carried by two arms arranged so they can swivel on the upper end of the casement. The sash is held in the swinging position by spindles that seat in grooves or channels on the side members of the casement and can move therein. In the hinged position, the sash is tightly connected to the arms. To increase comfort and improve operability, the grooves have no limits for the upper ends and the spindles are able to move longitudinally along the side rails of the sash by activating a handle in such a way that they are in the grooves in the swinging position and outside the grooves in the hinged position. At the same time, coupling elements are activated by the handle and are connected tightly to the arms in the hinged position of the sash, and this connection is released in the swinging position.

11 Claims, 14 Drawing Sheets

VENT AND TILT ROOF WINDOW

The invention concerns a hinged swinging skylight with a prop, whereby the sash can be pivoted in the center of its side rails by two arms arranged so they can pivot on the upper end of the casement, is put in the swinging position by two spindles arranged between the middle and the upper end of the sash on its side rails in grooves on the side members of the casement, and is firmly connected to the arms in the hinged position.

This type of hinged, swinging skylight is known from German Offenlengungschrift 2 708 785. In this skylight, the grooves have holes in their cover strips which lie in an area in which the spindles are located when the sash is in the closed position. The spindles are connected firmly to the sash. The window has a changeover switch lever which is used to connect the sash to the arms when the window is put into the hinged position. In the other position of the changeover lever, the sash is not connected to the arms, and it turns on the hanger on the arms when opened, and the spindles slide along the grooves to cause the swinging movement of the sash. Thus, the spindles do not come out of the opening of the grooves at the beginning of the swinging movement; and in the area near these openings; there is a snapping element whose resistance must first be overcome so that the spindles can come out of the opening. To help, there is a propping arm arranged on the casement that can turn and that presses against the arms from below by means of springs.

To work this window, you have to use both the window closing and opening lever and a changeover lever. So it is possible to make a mistake by not putting the changeover lever into the position where the sash is connected to the arms, but, when it is opened, the spindles are pushed out of the grooves against the resistance of the snapping elements, which, for example, is possible when someone pushes on the top part of the window to open it. In this case, the window goes into an unstable position in which the sash is hanging by its arms with no guidance. This can easily cause damage, and it is difficult to bring the window back to its original position. Another problem consists of the fact that, when the window is opened in the hinged position, the resistance of the snapping elements must be overcome by an increased expenditure of force.

The task of the invention is to develop a hinged, swinging skylight of the type mentioned so that comfort is increased and operability improved.

SUMMARY OF THE INVENTION

This task is solved by the skylight of the present invention which has no limit for the grooves on their upper ends and by making the spindles able to move longitudinally by activating a handle along the side rails so that they are in the grooves in the swinging position and outside the grooves in the hinged position. Coupling elements are simultaneously activated by the handle and they firmly connect the sash to the arms in the hinged position and eliminate this connection in the swinging position.

The advantage of such a hinged, swinging skylight mainly consists in comfortable handling due to the way it engages and disengages. The lever has the option of being in the hinged or the swinging position to open the window. If the sash is then opened, it automatically goes into the desired position. There is no additional resistance when opening the window in the hinged position, and, when opening it in the swinging position, it is not possible for the spindles to slide out of the grooves since they are in an area of the grooves which is below the open upper end of the grooves. Thus, with this window, if the sequence followed is that of choosing the type of opening with the lever and then opening the sash, it is no longer possible to make a mistake in operating it.

From the dependent claims, other convenient versions can be inferred which further increase the comfort, improve the seal of the window when it is closed, and rule out the possibilities of any type of malfunction to the greatest extent possible.

For this purpose, stops are provided on the arms, against which the sash hits when it reaches the hinged position; the upper end of the sash which is coming out of the swinging position cannot be swiveled further upwardly. In this way, the right position for safe, tight closing of the window is reached, which is also the position in which the coupling elements can connect the sash tightly to the arms.

To close the window, at least one pair of tongues is arranged on its side rails that can be moved longitudinally by moving the handle and thus work with the closing pieces arranged on the side members of the casement. The tongues fit into the closing parts when the sash is in the closed position, and, in the hinged and swinging position, they are pushed in such a way that they are out of range of the closing parts.

The advantage of this design is that the window can be put into the closed position or in a one of the opening positions mentioned by moving a single handle. Unlike the state of the art mentioned at the beginning, there is no stop pocket for engaging a lock on the lower end of the box frame, which is a disadvantage due to its visibility and possible dirt deposits. The closure described above is not only less visible, but also it has the advantage that it has several closing points—at least two—and in this way guarantees a tighter closing of the window. Depending on the size of the window, a larger number of closing points can be provided.

It is also proposed that the handle act on a straddling gear that moves two push rods in opposite directions. Such straddling gears are known and generally consist of a toothed wheel that works with a toothed rod connected to a push rod on each side. These push rods are connected with corner braces which transmit the movement to the other push rods, which are arranged on the side rails of the window sash. The other push rods work with the spindles, tongues and locks. This makes the individual elements arranged on both side rails work symmetrically. Such symmetry is necessary, especially for moving the spindles, since they must be moved up or down together.

The spindles fit into guides on the side beams and are connected tightly to the other push rods. This guarantees good guidance of the spindles and hence safe guidance of the window sash when it is swung open.

To obtain a good seal on the closed window, the tongues also fit into guides on the side rails and are connected tightly to the other push rods.

One advantageous design of the coupling element that connects the sash to the arms provides for locks to be mounted on the upper end of the side rails of the sash so they can move against the force of springs, and the locks have bevels. In a position corresponding to the hinged setting, the locks can be pushed back on the bevels by strike plates connected to the arms when they hit and catch in openings on the strike plate by the force of springs. The connections between the locks and the other push rods consist of longitudinal holes and sliding pads that fit into them, wherein there is locking when the lock is pulled back if the handle is moved into the swinging position.

Due to this design of the coupling elements, they can be activated by the handle and despite this are in a position to couple automatically to correct a malfunction. A malfunction can occur, for example, when the operating handle is moved into the swinging position when the open window is in the hinged position, wherein the coupling elements come apart, after which the window sash swivels on its arms on its hanger, and the hand lever is moved back into the hinged position. If someone now wants to close the sash without the proposed design or to move it back into the hinged position, this would not be possible. But with the proposed assembly, the coupling elements in such a case catch when the window is put in the hinged position, and the window can be closed with no problem. No damage can occur.

Damage due to another malfunction situation is prevented by having movable catches that can move against springs and are mounted on the upper ends of the cover strips of the grooves; when they are all the way out, they project over the cover strips on the upper ends of the grooves, and, by means of bevels when the spindles hit when the window closes, they get out of the way until the spindles are at the level of the grooves. After that, the springs close the catches again in their original position, and the spindles lie securely in the grooves. This measure takes care of the following malfunction situation: if the window sash is opened in the hinged position and the lever is then put in the swinging position, the window cannot be closed again, since the spindles would be hitting the cover strips of the grooves, and there is a danger of damage. But in the new design, the spindles in this situation strike the bevels of the catch and the catches are pushed back. When the catches are snapped back, the spindles are again in the grooves. This way, the sash is automatically put back into the right position, in which it is put in the grooves by the spindles after a malfunction.

The possibilities of malfunction by setting the handle with the window open can thereby be ruled out from the outset, by having a lock on the handle that locks the setting when the sash is open. However, it can also be convenient for the lock on the handle to work so that, when the sash is open, only one setting is locked between the hinged position and the swinging position. This would have the advantage that the closing part can be equipped with openings arranged at various levels to engage the tongues. The area of activation of the handle that is not blocked can then be used so that, when the sash is opened only a small amount can be locked in this setting for ventilation by having the tongues fit into the corresponding openings on the closing part.

One embodiment of the lock provides for one of the push rods to have an end projecting over the straddling gear with at least one notch into which a locking element fits when the open sash is in the swinging position. The locking element can be designed so that it projects into the closing path of the sash when engaged, and, when the sash is closed, is pushed against the force of a spring and thereby disengaged.

The lock can be designed for various functions. Depending on the arrangement of the notches or the end of the push rod, this can also work with the locking element completely to block a certain position or block the handle in one direction. Thus, when the sash is open in the hinged position, the end of the push rod can hit against the locking element, blocking the handle only in such a way that it cannot be moved into the swinging position.

Such a lock can be combined with the safety features described above that prevent malfunction, or it can be provided instead of them.

The combination has the advantage that no damage can occur when the lock is manually disengaged, which is an advantage for inspection and assembly work.

BRIEF DESCRIPTION OF THE DRAWINGS

The invention will be described below by means of the examples of embodiment shown in the drawings.

DETAILED DESCRIPTION OF THE ILLUSTRATED EMBODIMENT

Figure 1:
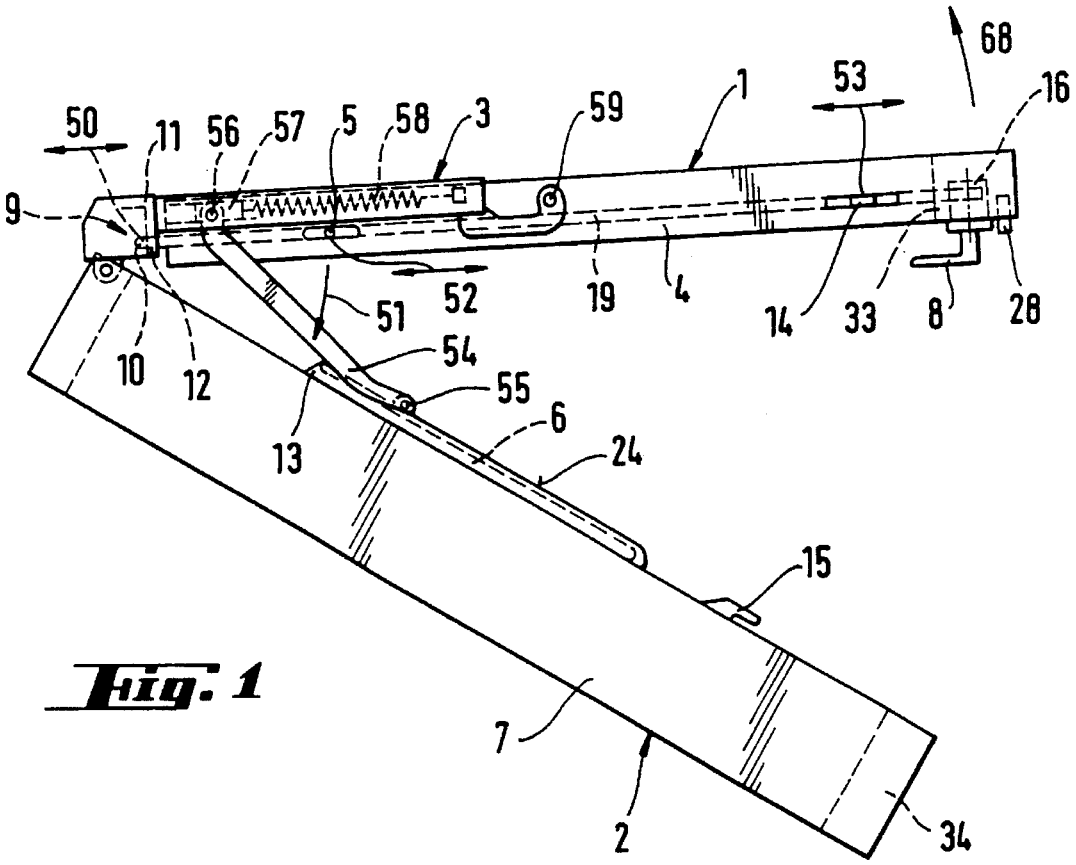
FIG. 1 is a schematic side view of the skylight in the hinged position.

FIG. 1 is a schematic side view showing the skylight of the present invention in the hinged position. The casement 2 is in a position that corresponds to its being installed in a roof. The sash 1 is folded up, and it is tightly connected to the arms 3 by coupling elements 9. To make it easier to open the sash 1 or to hold it in the open position, there is a prop that consists of a spring arm 54 on each side of the sash 1 and it has a pivot 55 on the casement and a pivot 56 on the arm 3. The pivot 56 is on a sliding element 57 which can be moved in the arm 3. The sliding elements 57 in the arms 3 are pulled by springs 58 in the direction of the front end of the arm 3, causing a force for opening the sash 1. The arms 3 are arranged so they can pivot on the upper end of the casement 2 and have hangers 59 on their front ends, and the sash 1 can pivot about the axis formed thereby.

The solution in the invention is not limited to the prop which has been described. Another prop can be used, for example, the prop arm 3 known from the state of the art mentioned previously. FIG. 1 schematically shows the elements which are adjustable by the handle 8. These are the tongues 14, the spindles 5 and the lock 10. These three elements are adjusted by the handle 8 in the direction of the double arrows 50, 52 and 53. They are arranged on both sides of the side rails 4 of the sash 1. The tongues 14 work with the locking elements 15 arranged on the casement 2; in the closed position, the tongues 14 fit into the locking elements 15 and are outside the contact area in the hinged and swinging positions. The spindles 5 and the lock 10 are adjusted at the same time as the tongues 14. In the hinged position shown, when the sash 1 is closed, the spindles 5 are over the end 13 of the grooves 6 which are disposed inside the side members 7 of the casement 2. In the hinged position, the lock 10 is moved into the openings 12 by strike plates 11 connected to the arms 3. From the hinged position, the sash 1 can be closed with no problem, since the spindles 5 follow the path of the arrow 51, and hence do not hit the cover strips 24 for the grooves 6.

Figure 2:
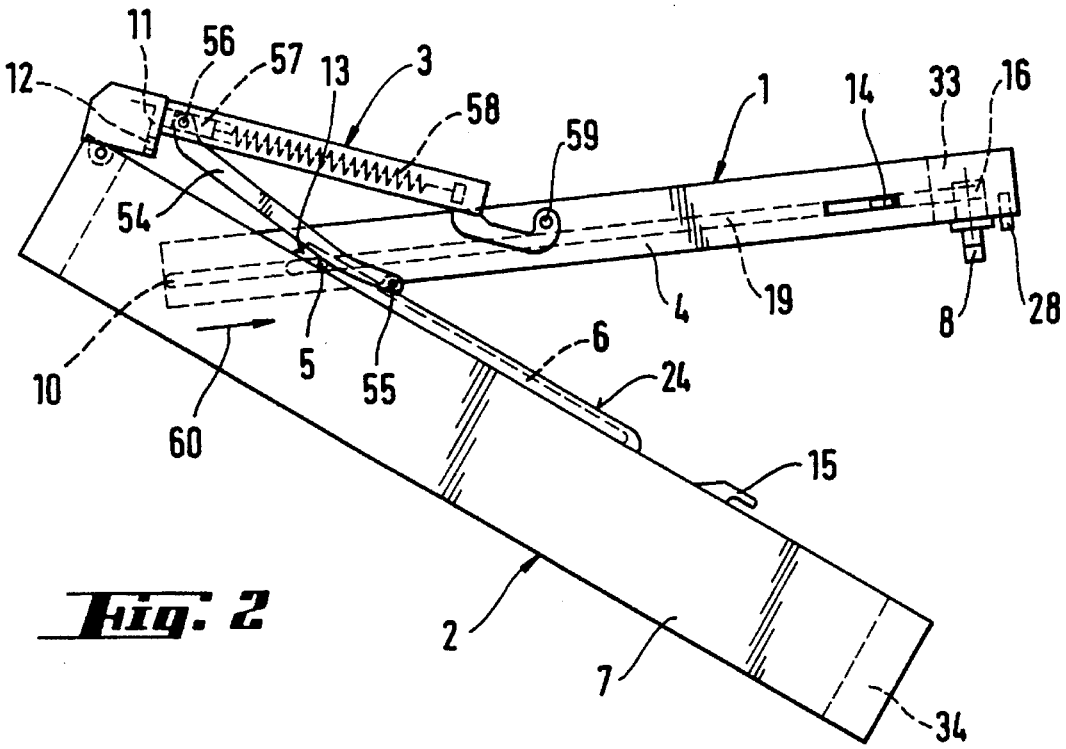
FIG. 2 is a schematic side view of the skylight in the swinging position.

FIG. 2 shows the same schematic side view of the skylight but in the swinging position. In order to move into the swinging position, the window must first be closed and start from the hinged position shown in FIGS. 2 in order to move the handle 8 to the position corresponding to the swinging position. In this manner, the spindles 5 are moved in the direction of the front end of the sash 1 (arrow 60) in which they move into the upper ends 13 of the grooves 6. At the same time, the lock 10 is pushed back so that the coupling elements 9 no longer connect the arms 3 and the sash 1. If the sash 1 is opened after this adjustment, the sash 1 makes a swinging movement on the hangers 59 on the arms 3, and the spindles 5 slide down in the grooves 6, and the sash 1 takes the position shown. Also in the swinging position, the spring 58 makes sure that the sash 1 can be opened easily or stays in its open position. The window is positioned very stably in the swinging position, since it is both held by the arms 3 and moved by the spindles 5 in the casement 2. The functions of the elements shown schematically here are explained in greater detail using the following figures.

Figure 3:
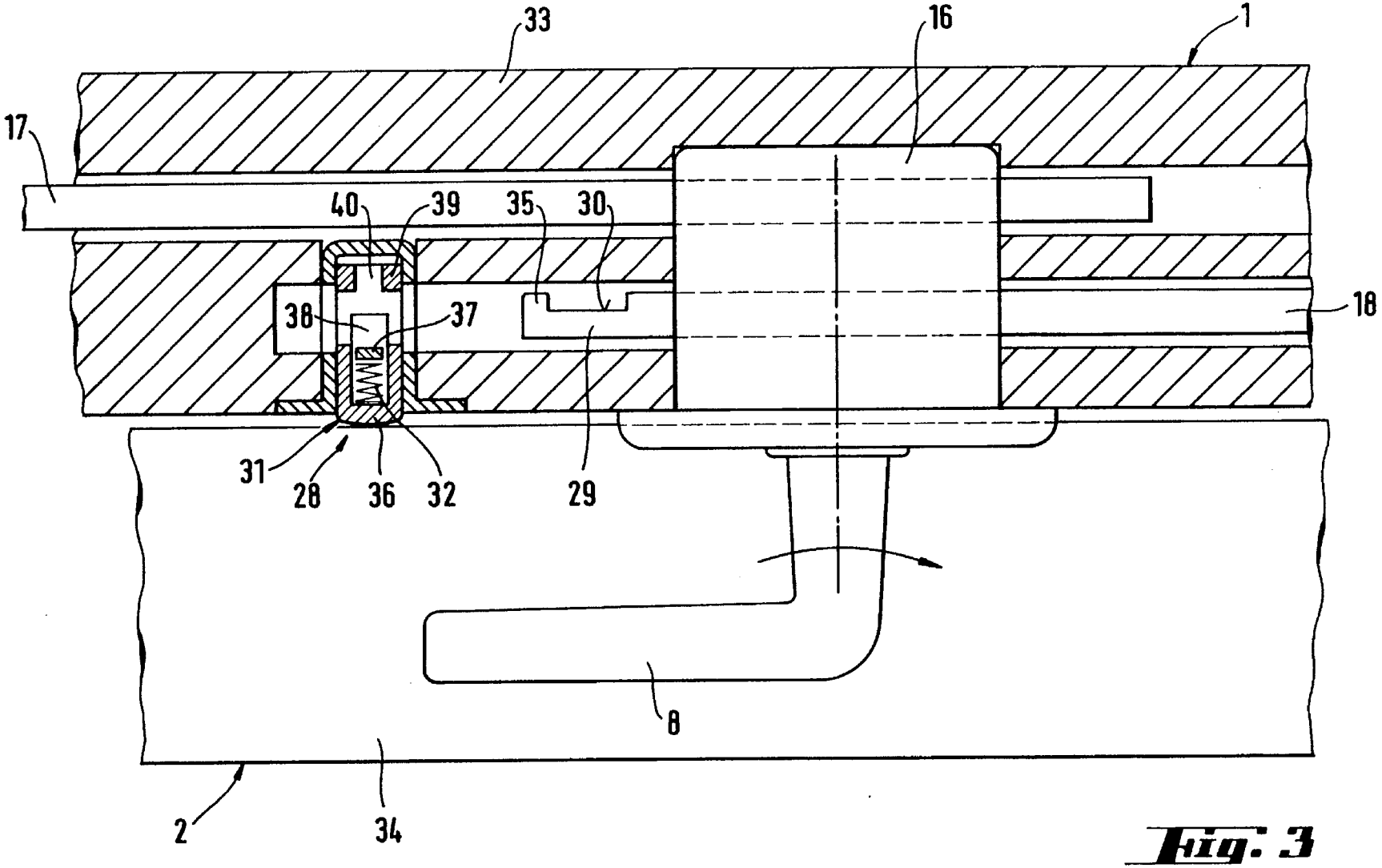
FIG. 3 is an enlarged view of the lower cross member of the sash and of the casement in the closed position with the handle in a position corresponding to the locked setting of the lock.

FIG. 3 is an enlarged view of the lower cross members 33 and 34 of the sash 1 and the casement 2 in the closed position with the handle 8 in a position corresponding to the closed setting and with a safety feature in the form of a lock 28 to prevent malfunction.

Figure 3A:
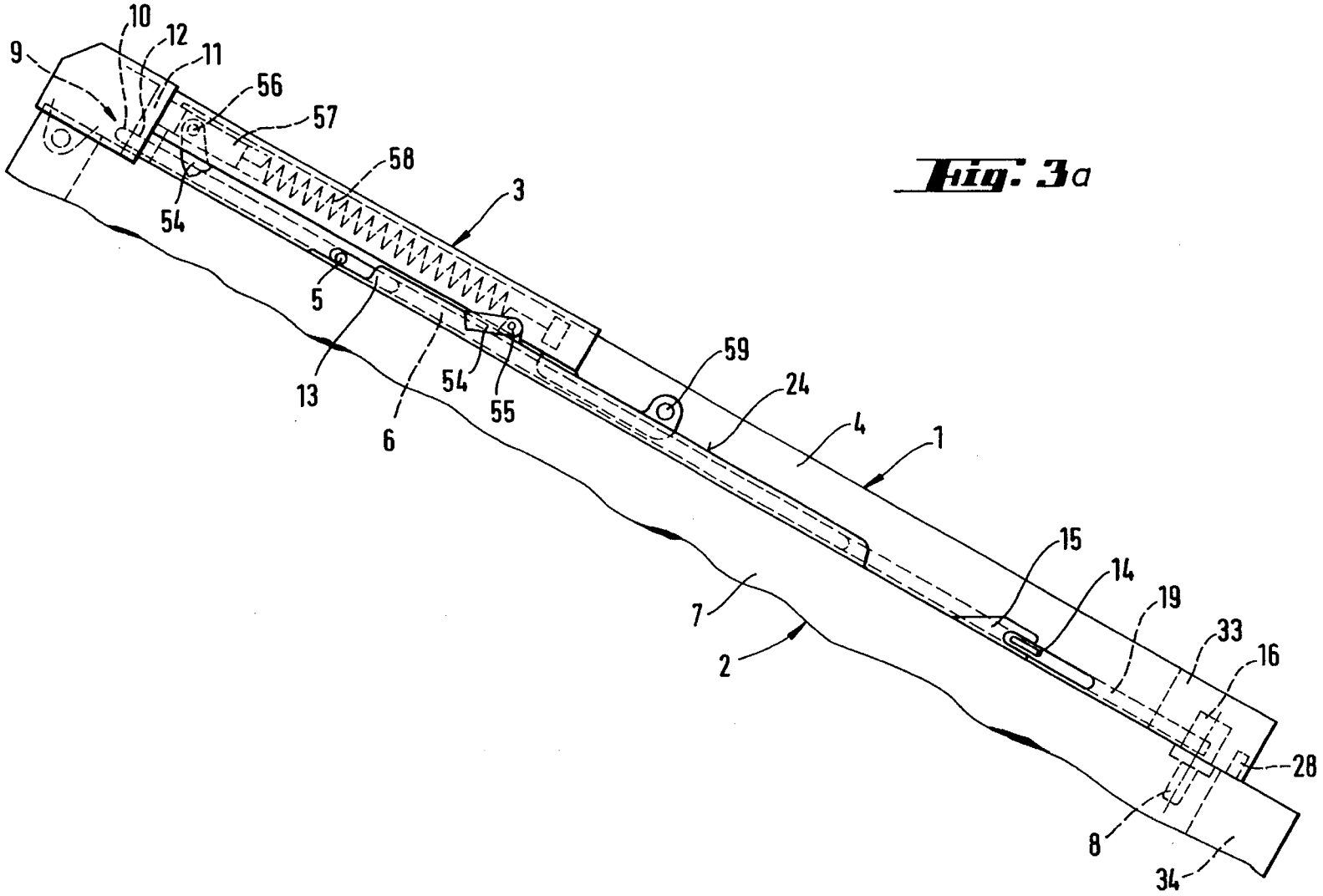
FIG. 3*a* is a schematic side view of the skylight in the position corresponding to FIG. 3.

FIG. 3*a* is a schematic side view of the window in a position corresponding to FIG. 3. The handle 8 is in a position in which the sash 1 is closed. Here the tongues 14 fit into the closing parts 15. The spindles 5 are above the upper ends 13 of the grooves 6, and the locks 10 are in the openings 12 in the strike plates 11. The tongues 14, the spindle 5 and the lock 10 are adjusted by having the handle 8 connected to a straddling gear 16 (not shown in detail here), which consists, for example, of a toothed wheel and two toothed portions on the push rods 17 and 18 which mesh with the bottom and top of the toothed wheels. The push rods 17 and 18 are moved in opposite directions by the straddling gear 16 and transmit these movements by the corner braces to other push rods which are arranged on the side rails 4 of the sash 1. One of the other push rods 19 is shown; on the other side of the sash 1, there is a corresponding push rod, which also adjusts a tongue 14, a spindle 5 and a lock 10.

FIG. 3 also shows a lock 28 which is used to lock the handle 8 in certain positions, as is explained further below. The lock 28 consists of a locking element 31 mounted so that it can move on the cross member 33, and it acts on a spring 32 in the direction of the lower cross member 34 of the casement 2. The spring 32 is clamped between the bend 36 of a locking element 31 and a holding catch 37 which is connected to the lower cross member 33 of the sash 2. The holding catch 37 projects out of a recess 38 in the locking element 31. A stop 39 with an opening 40 cooperates with one end 29 of the push rod 18 projecting beyond the straddling gear 16. To do this, the end 29 of the push rod 18 has a notch 30 which can be configured so that a hook 35 is formed on the end 29 of the push rod 18. Of course, it is also possible to provide this arrangement on the other push rod or to add such a notch in another area of the push rods 17 or 18 and to arrange the locking element 31 there.

Figure 4:
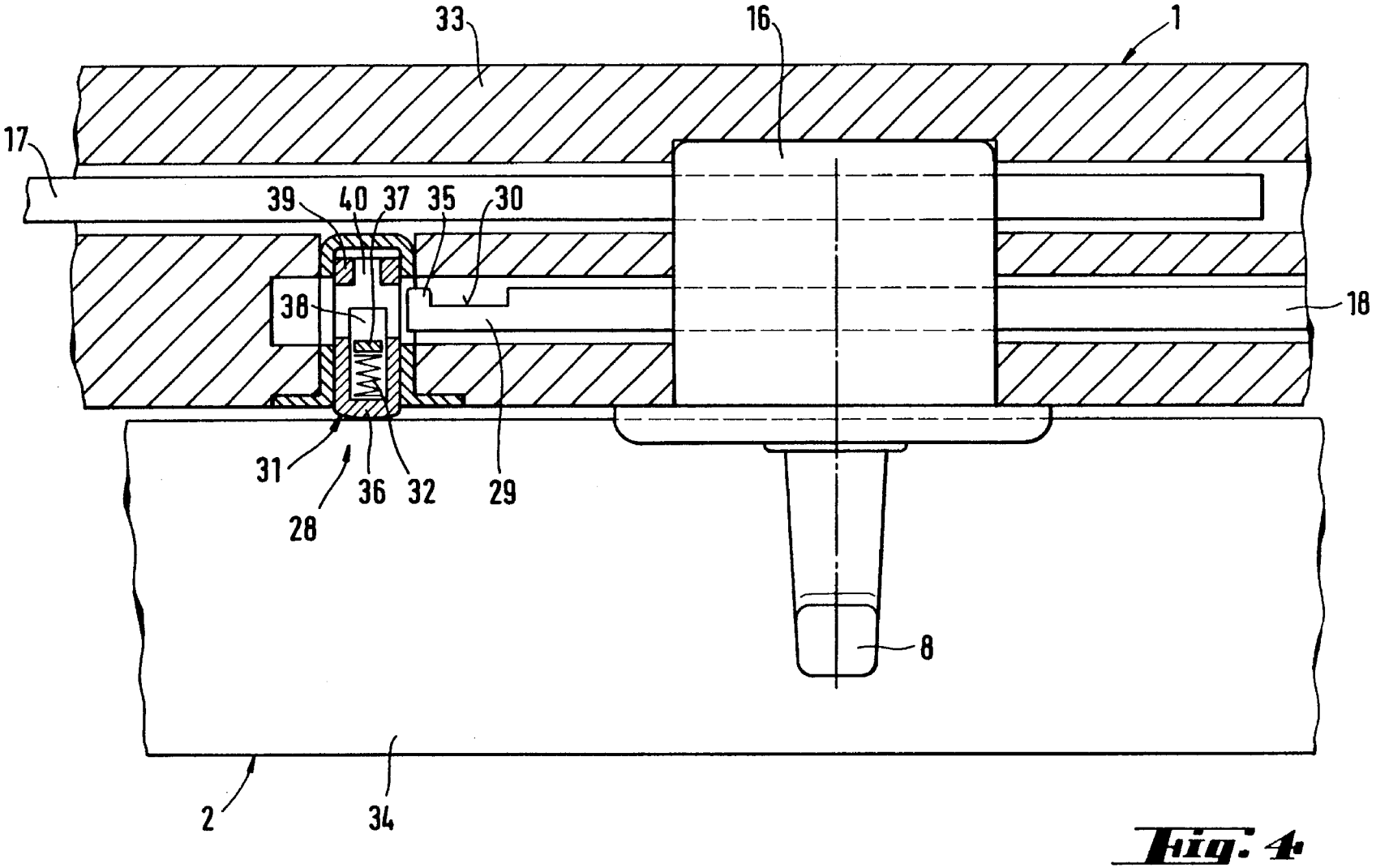
FIGS. 4 and 4*a* illustrate the parts in FIGS. 3 and 3*a*, but with the handle in the hinged position.
Figure 4A:
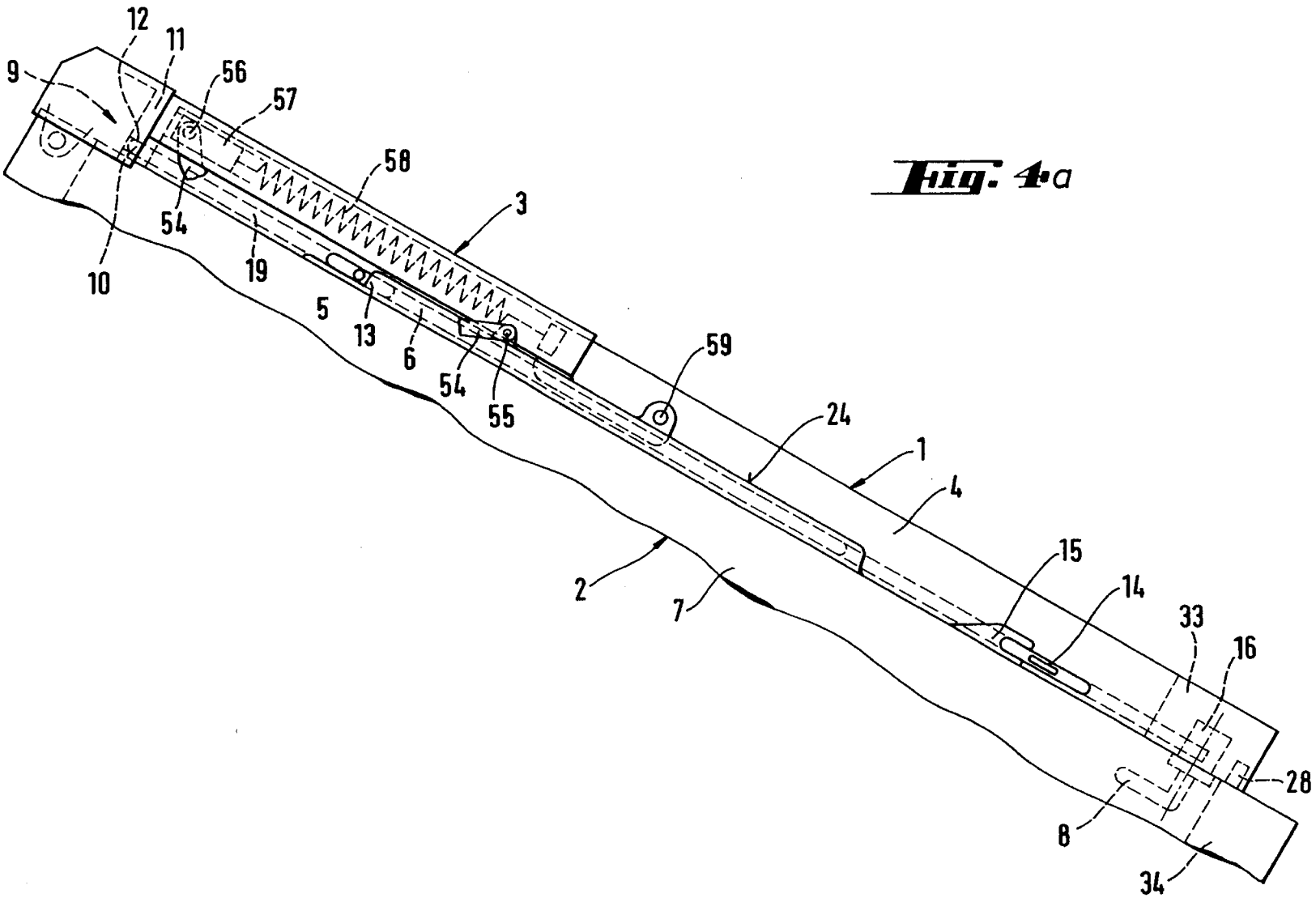

FIGS. 4 and 4*a* show the same structural assembly as in FIGS. 3 and 3*a*, but the handle 8 has been moved into the position in which the working parts of the window are in the hinged position. The sash 2 is still closed, but it can be moved out of this position with no trouble and then goes into the hinged setting without doing anything else. The handle 8 has been set in a vertical position, rather than the horizontal position shown in FIG. 3, by activating the two push rods 17 and 18. In this way, the tongues 14 have been moved so that they no longer fit into the closing elements 15. The spindles 5 are also adjusted, but they are above the upper ends 13 of the groove 6. The lock 10 has also been moved, but it still is engaged in the openings 12 of the strike plates 11 which are connected to the arms 3. The lock 28 is still disengaged.

Figure 5:
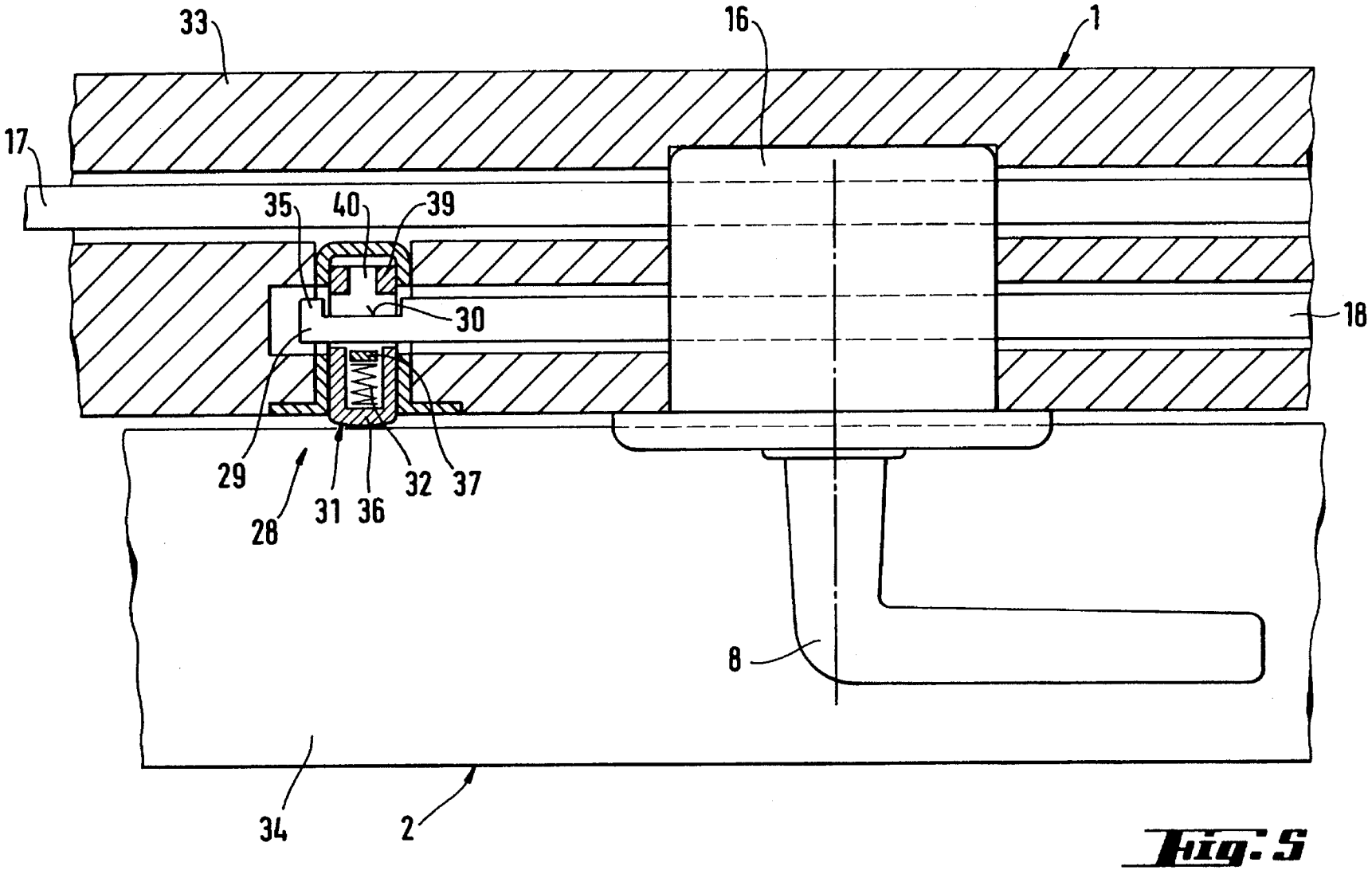
FIGS. 5 and 5*a* illustrate the same parts with the handle in the swinging position.
Figure 5A:
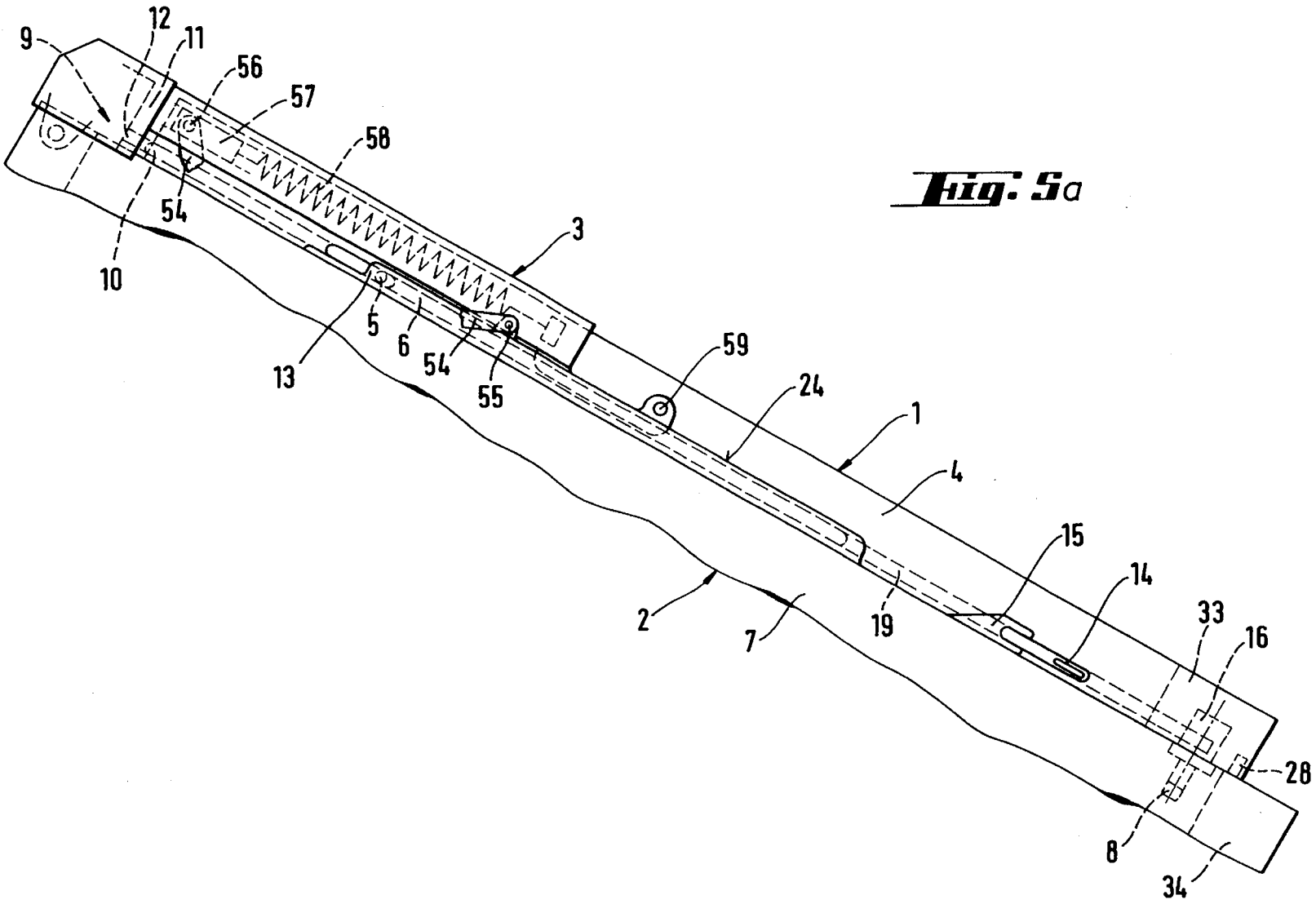

FIGS. 5 and 5*a* illustrate the same structural assembly as in FIGS. 3, 3*a*, 4 and 4*a*, but the handle 8 is set in a position in which the working parts of the sash 1 are in the swinging position. Here the sash 1 is still in its closed position, but it would go into its swinging position immediately when opened, as is shown in FIG. 2. By further adjusting the handle 8 to a position opposite that in FIG. 4, the push rods 17 and 18 are moved even more in the opposite direction, and the tongues 14 have moved further away from the closing parts 15. The spindles 5 have gone into the grooves 6. The locks 10 have come out of the openings 12 in the strike plates 11; the coupling elements 9 are uncoupled; and the sash 1 is no longer connected to the arms 3.

The end 29 of the push rod 18 has been moved so far that the notch 30 is precisely under the stop 39 of the locking element 31. If the sash 1 is opened in this position (FIG. 8), the locking element 31 moves downwardly under the action of the spring 32 since the lower cross member 34 of the casement 2 moves away from the lower cross member 33 of the sash 1. Thus, the stop 39 engages in the notch 30, and the handle 8 is locked in position. It can only be activated again when the sash 1 is closed and is thereby adjacent to the casement 2; the lower cross member 34 pushes the locking element 31 back out of its stop position and the end 29 of the push rod 18 is released.

Figure 6:
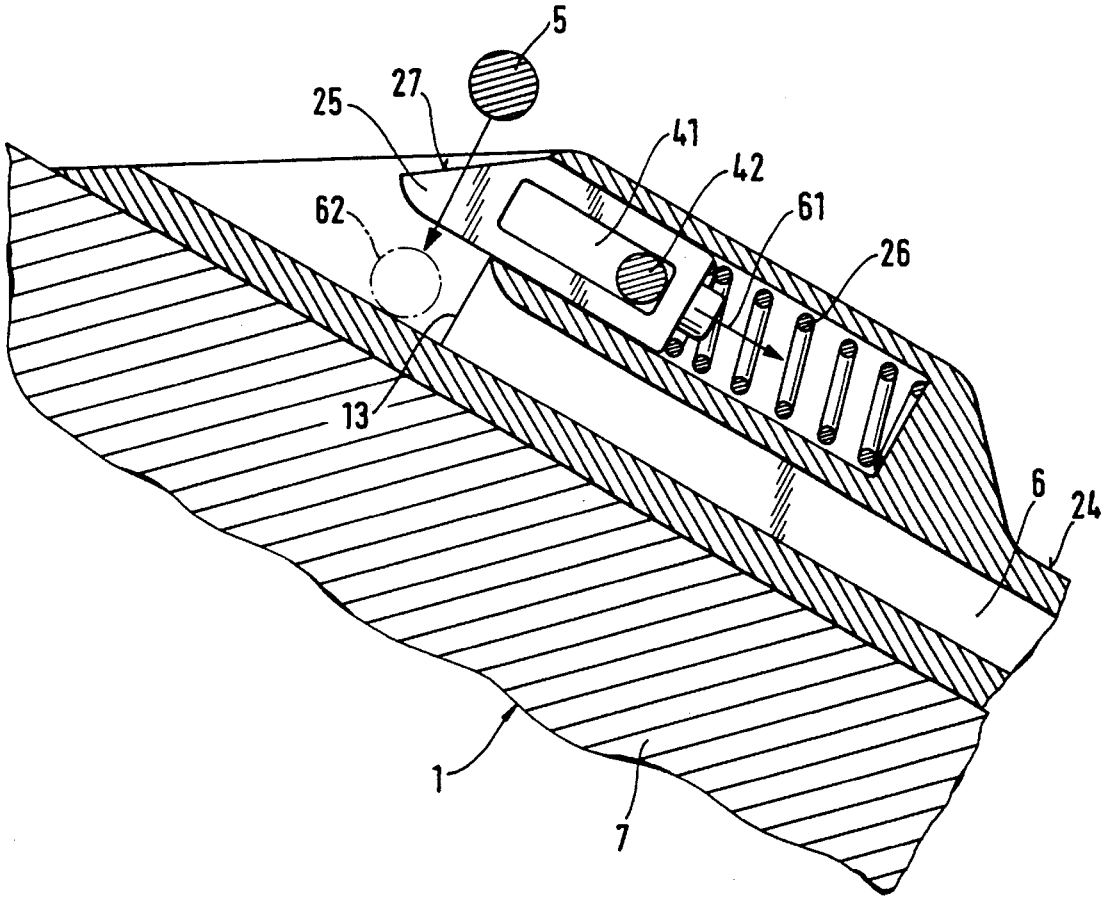
FIG. 6 illustrates another or additional safety feature to prevent malfunction.

FIG. 6 shows another safety feature against malfunction, and it either works with the lock 28 or is provided instead of the lock 28. This safety feature consists of a catch 25 which is arranged on the cover strip 24 of the grooves 6 in the area near the upper ends 13 of those grooves 6. The parts exposed by the cross section show that the catch 25 is acted upon by a spring 26, and a longitudinal opening or slot 41 and a guide element 42 make sure that the catch 25 is held in a position in which a portion projects over the upper end 13 of the groove 6. This portion is dimensioned and configured with an upwardly disposed beveled edge 27 aligned with the spindle 5.

The purpose of this design is that the sash 1, which is opened in the hinged position, can also then be closed when the handle 8 is moved in this open position into the swinging position. This can happen either when the lock 28 is omitted, or when the locking element 31 is pushed in and disengaged and it is possible to bring the handle 8 into the swinging position. If the window were closed without the safety device described, this would mean that the spindles 5 are in a position in which they hit the cover strips 24 of the grooves 6 when closed, and damage may occur. This situation can be imagined in FIG. 5*a* if it is assumed that the spindle 5 is not in the groove 6, but above the cover strip 24 of the groove 6, and the window is pushed shut. With the safety device in FIG. 6, however, the spindles 5 do not hit the cover strips 24, but hit the beveled edges 27 of the catch 27, and this causes the catches 25 to move in the direction of the arrow 61, slide the spindles 5 into the area of the grooves 6, and then return the catches 25 to their original position. Thus, the spindles 5 are engaged in the grooves 6 as shown by the spindles 62 drawn in broken lines. In this way, such a malfunction can easily be corrected by closing the window without causing damage.

Figure 7:
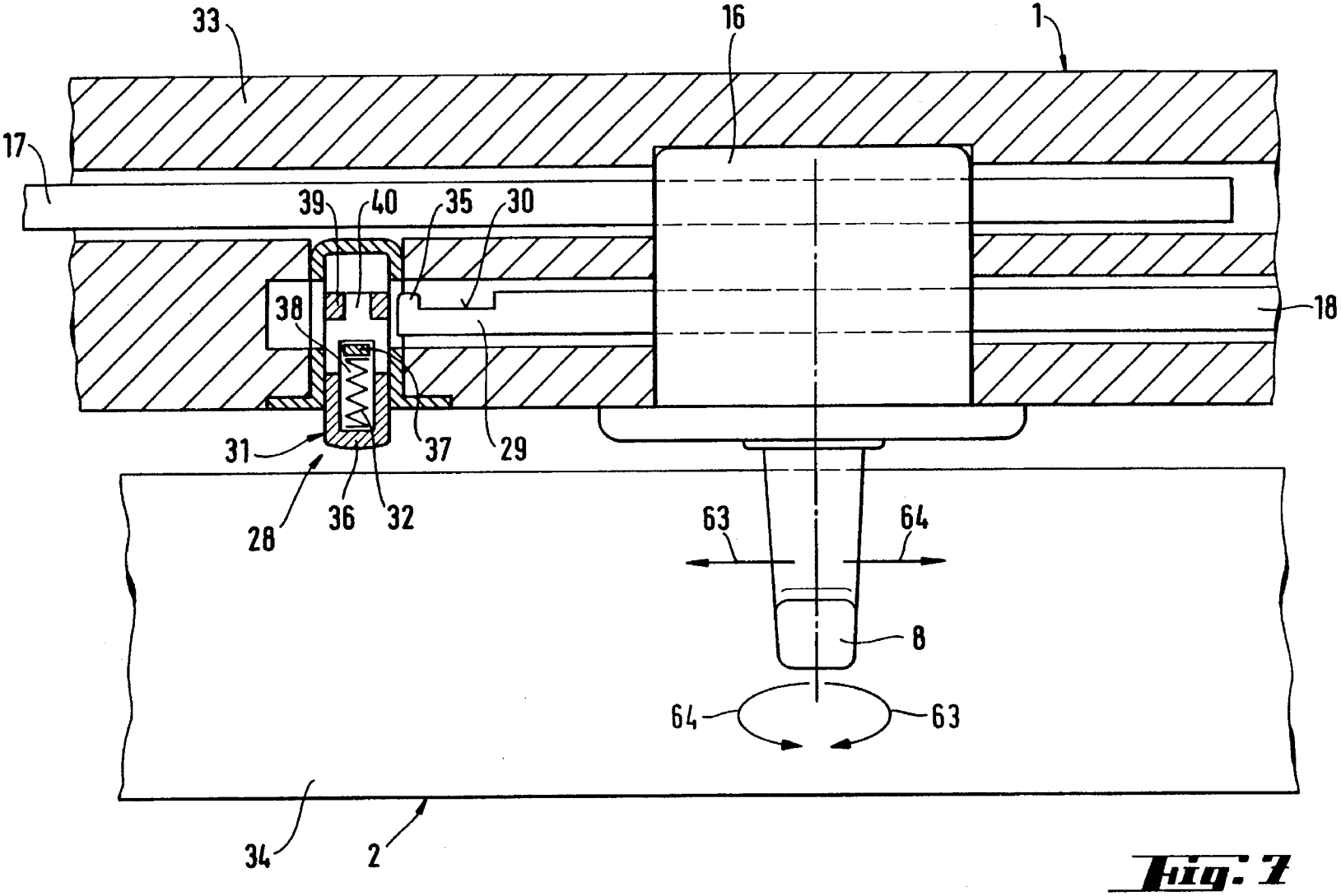
FIG. 7 is an enlarged portion of the lower cross member of the sash and the casement in the open position with the handle in a position corresponding to the hinged position and the lock.
Figure 8:
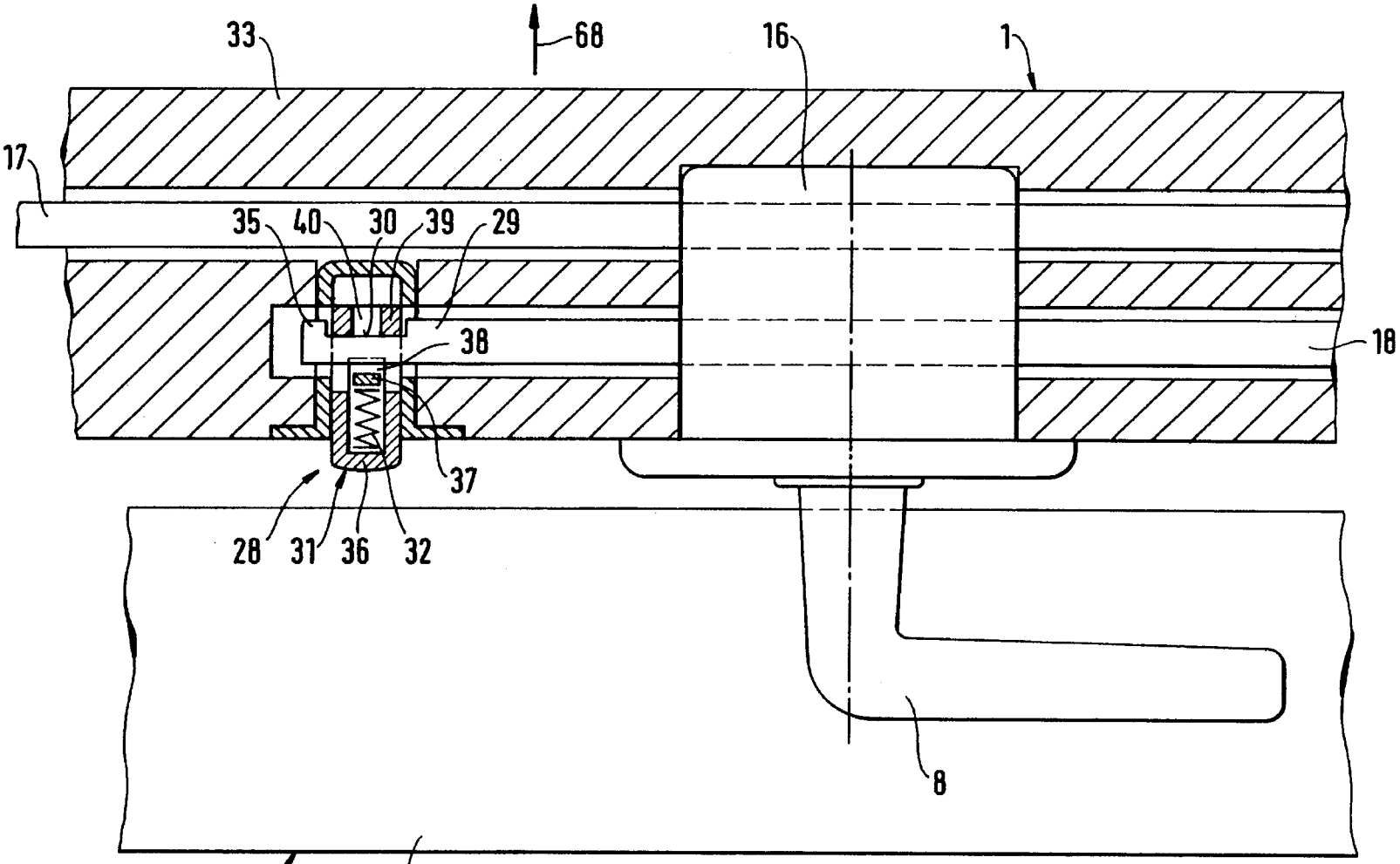
FIG. 8 illustrates the ventilation device of FIG. 7, but with the handle in the swinging position.
Figure 9:
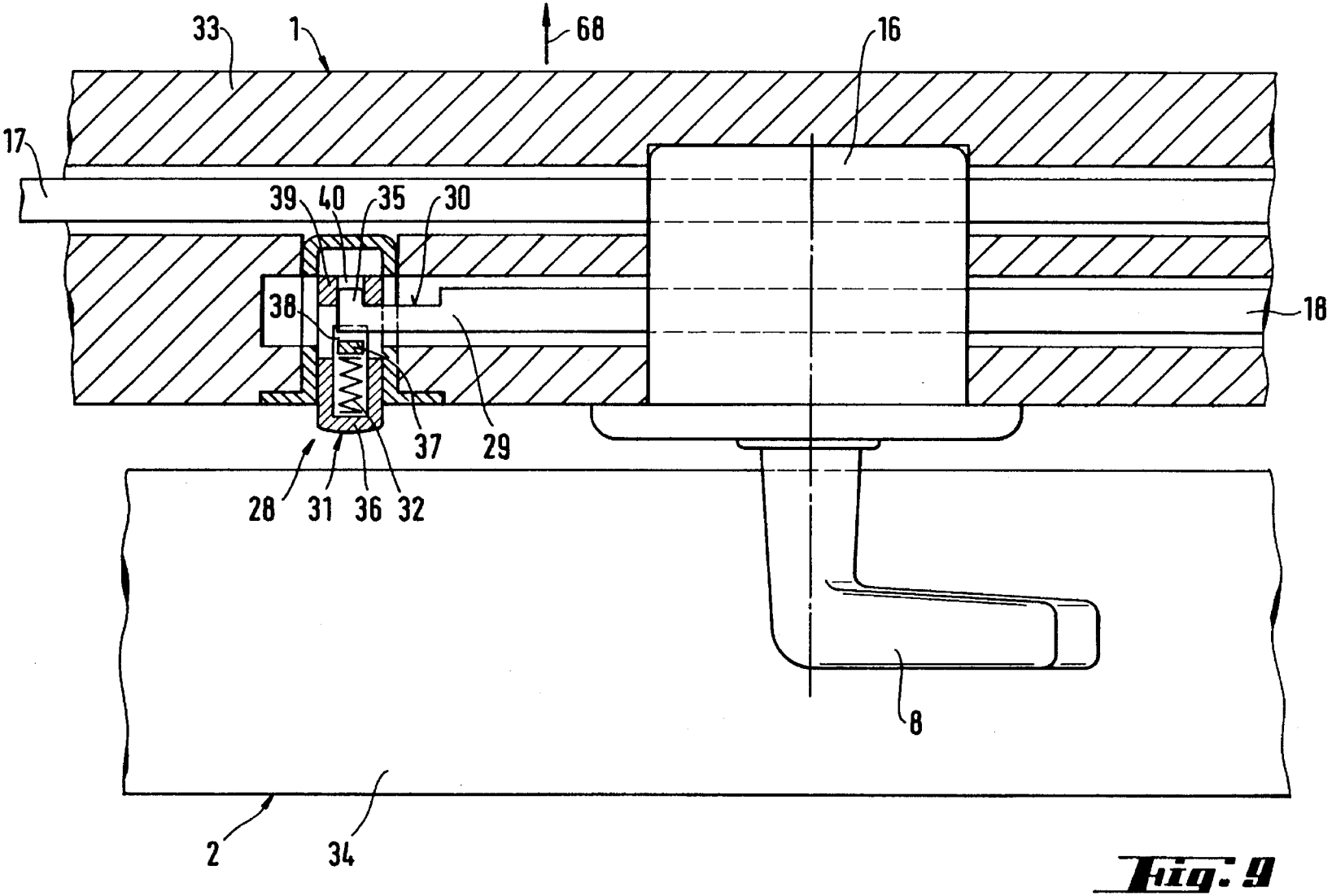
FIG. 9 illustrates the ventilation device of FIG. 7, but with the handle between the hinged and the swinging positions.

FIGS. 7, 8 and 9 illustrate how the lock 28 on the handle 8 works when the window is opened. The drawings are an enlarged portion of the lower cross members 33, 34 of the sash 1 and the casement 2, as was already shown in FIGS. 3 to 5, but the sash is in the open position and the lower cross member 33 of the sash 1 has moved away from the lower cross member 34 of the casement 2.

FIG. 7 first shows the position of the handle 8 in which the sash 1 is in the hinged position. When it is opened, the spring 32 drives the locking element 31 downwardly, and the end 29 of the push rod 18 is opposite the stop 39. In this way, the handle 8 can be moved in the direction of the arrow 63, and the handle 8 can thus be adjusted in the closing direction. The opposite adjustment in the direction of the arrow 64, in the swinging position, is not possible, since the end 29 of the push rod 18 would hit against the stop 39 and be blocked by such a movement.

Figure 7A:
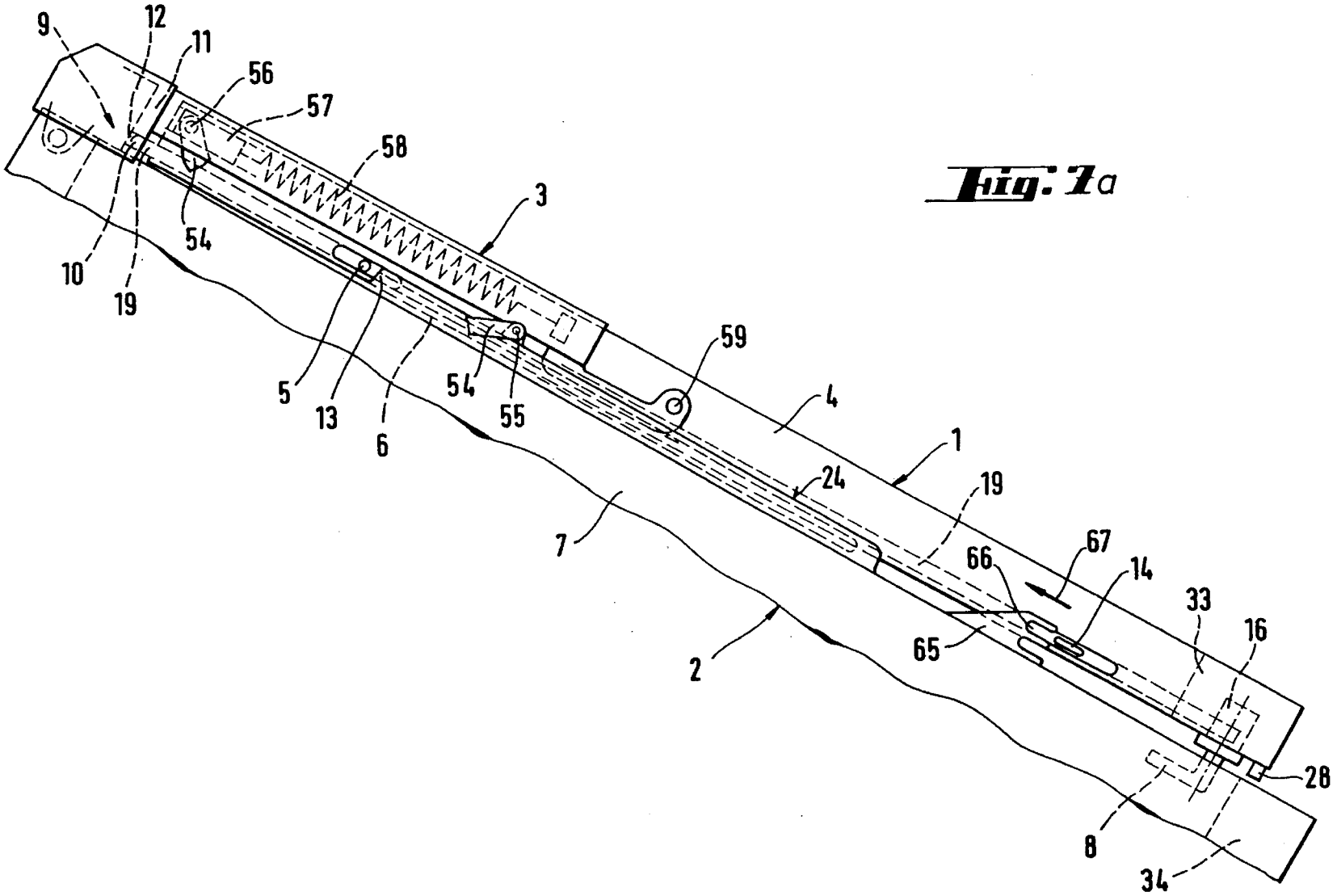
FIG. 7*a* illustrates a ventilation device.

This one-sided blocking of the handle 8 makes it possible to bring the sash 1 into a ventilating position while maintaining the blocking in the direction of an adjustment in the swinging position. For this, it is necessary to provide ventilation openings 66 on the side members 7 of the casement 2, as FIG. 7*a* shows. This figure shows how, when there is a ventilation gap between the casement 2 and the sash 1, the tongue 14 goes into the ventilation opening 66 of the closing element 65, and the sash 1 is stopped by it.

FIG. 8 shows the same parts as in FIG. 7, but the handle is in the swinging position. This position was already shown and described in FIG. 5; it can be seen from FIG. 8 that, because of the opening movement of the sash 1 in the direction of the arrow 68, the locking element 31 is moved downwardly by the spring 32. The locking element 31 holds the end 29 of the push rod 18 by having the stop 39 engage in the notch 30. In this way, the handle 8 is held firm, and it is not possible when the sash 1 is open to adjust it, which could lead to a malfunction.

FIG. 9 in turn shows the same parts as in FIGS. 7 and 8, but shows a measure taken to prevent the handle 8 from going into a setting in between the hinged and swinging positions, and in which the sash 1 is opened and the handle 8 is adjusted so that it malfunctions. The measure shown consists of having the stop 39 of the locking element 31 contain an opening 40 which is designed so that the hook-shaped end 35 of the push rod 18 can engage in this opening 40. In this way, the handle 8 is also stopped in such an intermediate position, and it is not possible to switch out of this intermediate position into the swinging position although the spindles 5 are not in the grooves 6.

Figure 10:
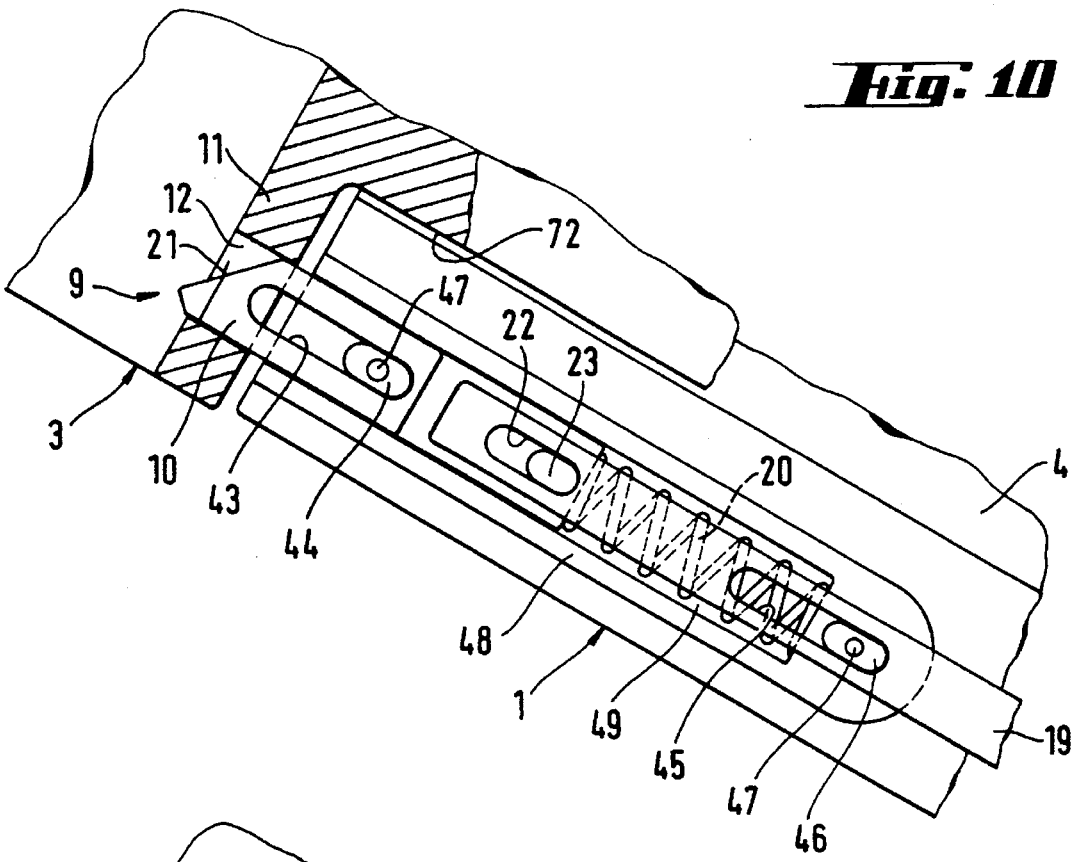
FIG. 10 illustrates the coupling element for connecting the sash to the arms with the window closed.

FIGS. 10 to 13 show an embodiment of the coupling element 9 for connecting the sash 1 to the arms 3 where another malfunction may occur. FIG. 10 shows the coupling element 9 in the position for a closed window.

On the upper ends of the side rails 4 of the sash 1, housings 48 are added that contain movable locks 10. The lock 10 is provided with a longitudinal opening or slot 43 in which a guide element 44 connected to the housing 48 is located, whereby the adjustment path of the lock 10 is predetermined. The lock 10 is shown in its out position, in which it is pressed against a spring 20. In this position, the lock 10 engages in the opening 12 of a strike plate 11 which is connected to an arm 3. In the direction of the arm 3, the end of the lock 10 is formed with a bevel 21. On the other end, the lock 10 interacts with the other push rod 19 in which there is a longitudinal hole 22 in which is seated a sliding pad 23 on the lock 10. The longitudinal hole 22 and the sliding pad 23 are arranged so that the other push rods 19 can pull back a certain way without taking the lock 10 with them. The dimensions are such that uncoupling takes place only when the handle 8 is moved from the hinged position into the swinging position. The other push rod 19 engages in the hollow space 49 of the housing 48. An opening 45 in the push rod 19 and a guide element 46 that is connected to the housing 48 also serve as guides.

Figure 11:
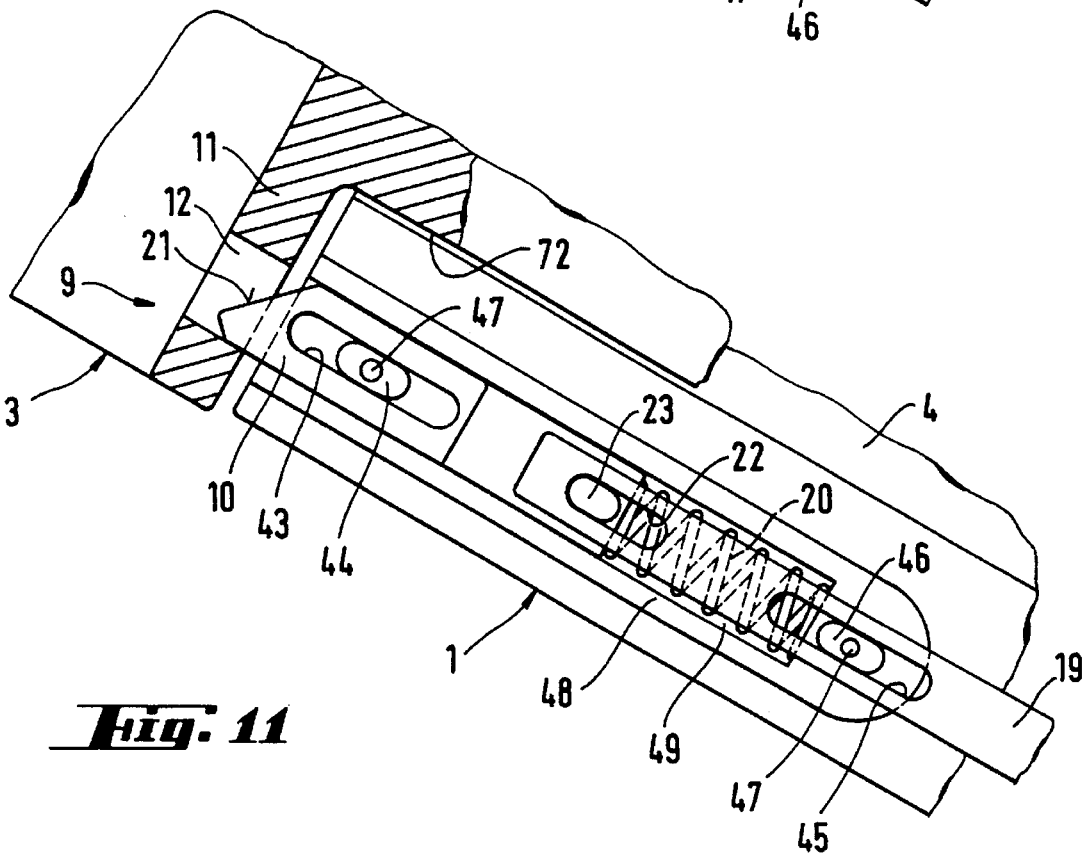
FIG. 11 illustrates the coupling element in the hinged position.

FIG. 11 shows the coupling element 9 after adjustment of the handle 8 in the hinged position. The push rod was adjusted and grasped the lock 10 by means of the longitudinal hole 22 on the sliding pad 23 and pulled it back a way. In this position, the coupling element 9 is still engaged. The sash 1 is therefore still connected to the arms 3.

Figure 12:
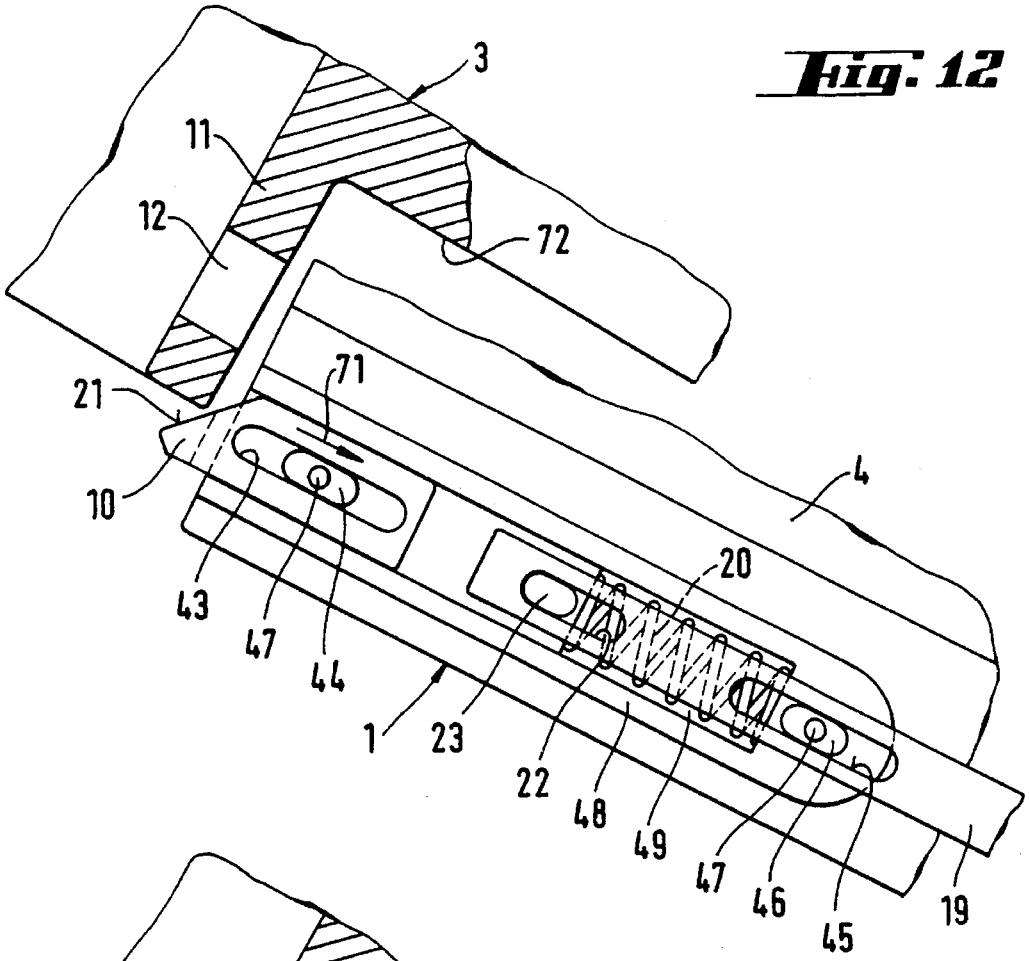
FIG. 12 illustrates the coupling element with a malfunction correction.

FIG. 12 shows the coupling element in the same position as in FIG. 11, but before the handle 8 is brought into the hinge-setting position; the connection between the sash 1 and the arms 3 is broken, switching off the lock 28 and causing a malfunction. If the sash 1 is now moved back into the closed or hinged position, the lock 10, if it were connected tightly to the push rods 19, would hit the strike plate 11, and it would no longer be possible to reach the coupled position. If this happens when the window is being closed, there would be a danger of damage. In the embodiment illustrated, however, the strike plate 11 hits the bevels 21 of the lock 10, and they go back into the housing 48 in the direction of the arrow 71 against the force of the springs 20, until the position shown in FIG. 11 is reached and the locks 10 catch in the openings 12 in the strike plate 11 due to the force of the springs. The dimensions of the longitudinal holes 22 and the openings 43 and 45 must cooperate in their length so that the lock 10 can return in this way. With this design of the coupling elements 9, a malfunction can be corrected by having the window closed and connecting the sash 1 to the arms 3 again.

Figure 13:
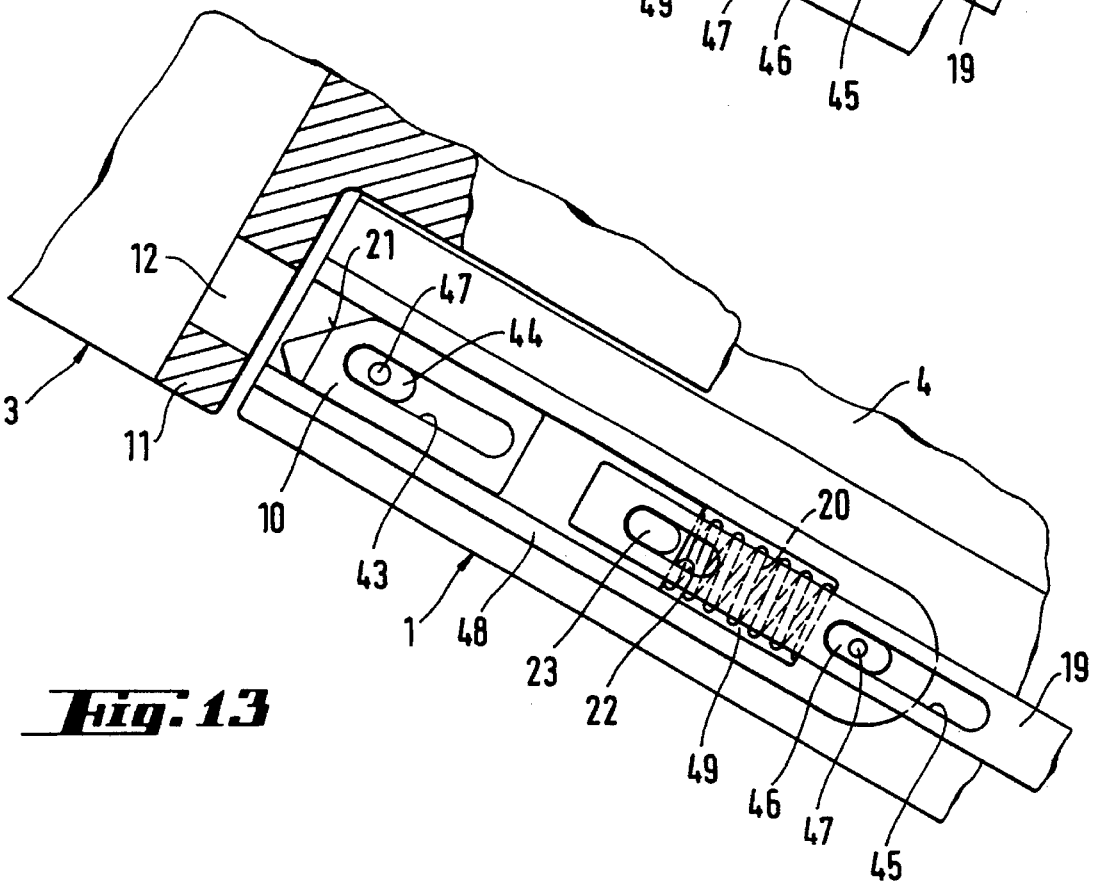
FIG. 13 illustrates the coupling element in the swinging position.

FIG. 13 shows the coupling element in the uncoupled position. To achieve this position, the other push rods 19 are pulled back using the handle 8 in such a way that the lock 10 reaches its end position. When it is pulled back like this, the sliding pad 23 hits the lock end of the longitudinal hole 22, and the push rod 19 pulls the lock 10 against the force of the springs 20 into the position shown.

Having thus described the invention, what is claimed is:

1. A hinged, swinging skylight comprising:

(a) a sash having upper and lower ends and a pair of side rails extending therebetween;

(b) a casement in which said sash is disposed and having a pair of side members;

(c) a pair of arms pivotably connected at one end to said casement and at the other end to said side rails of said sash;

(d) spindles on said sash between the middle and said upper end of said sash on said rails thereof and movably seated in channels in said side members of said casement, said spindles being movable between a first position in which they are firmly connected to said arms and in which said spindles are seated in the end of said channels adjacent said upper end of said sash in the hinged position of said sash and a second position in which they are slidably seated in said channels of said side members in the swinging position of said sash; and said spindles being movable longitudinally along said side rails in said channels in the swinging position of said sash;

(e) a handle movably mounted on said lower end of said sash and operatively connected to said spindles for movement thereof; and (f) coupling elements movable by said handle, between a first hinged position in which they connect said sash firmly to said arms, and a second swinging position in which they are disconnected from said arms.

2. A hinged, swinging skylight in accordance with claim 1, wherein said sash hits a stop on said arms when it reaches the hinged position, and wherein the upper end of said sash cannot be swiveled further upwardly.

3. A hinged, swinging skylight in accordance with claim 1, wherein at least one pair of tongues is provided on said side rails of said sash and are operatively connected to said handle, said tongues being movable longitudinally by moving said handle, said tongues cooperating with locking elements arranged on said side members of said casement so that said tongues fit into said locking elements when said sash is in the closed position and are outside said locking elements in the swinging and hinged positions.

4. A hinged, swinging skylight in accordance with claim 3, wherein said handle rotates a straddling gear which drives two push rods, which are connected by corner braces to other push rods on said side rails of said sash, said other push rods being engaged with said spindles, said tongues and said coupling elements.

5. A hinged, swinging skylight in accordance with claim 4, wherein said spindles move in guides on said side rails of said sash and are firmly connected to said other push rods.

6. A hinged, swinging skylight in accordance with claim 4, wherein said tongues move in guides on said side rails of said sash and are firmly connected to said other push rods.

7. A hinged, swinging skylight in accordance with claim 4, wherein a lock on said coupling element at said upper end of said side rail of said sash is mounted and springs bias said lock towards the upper end of said sash; wherein said lock has a bevelled surface; wherein strike plates are provided on said arms and abut said bevelled surfaces and cam said locks in the direction away from said upper end of said sash openings, on said strike plates said strike plates having openings therein in which said locks engage by the force of said springs; and wherein the connection between said lock and said other push rods consists of longitudinal holes and sliding pads movable in said holes, so that, when said locks are pushed back by said strike plates, said pads move if said handle is moved into the swinging position of said sash.

8. A hinged, swinging skylight in accordance with claim 4 wherein one of said push rods has an end projecting over said straddling gear with at least one notch into which a locking element seats when said sash is open in the swinging position and its end abuts said locking element when said sash is open in the hinged position.

9. A hinged, swinging skylight in accordance with claim 8, wherein said locking element projects into the closing path of said sash when said locking element is seated in said notch of said push rod, and, when said sash is closed, it is pushed against the force of a spring and is thereby disengaged from said push rod.

10. A hinged, swinging skylight in accordance with claim 1, including catches movably mounted on the upper ends of cover strips for said channels and springs biasing said catches into an extended position projecting beyond the upper ends of said cover strips at the upper ends of said channels, said catches having bevelled surfaces, said spindles abutting said bevelled surfaces and moving said catches against said springs as the sash closes until said spindles are aligned with said channels.

11. A hinged, swinging skylight in accordance with claim 1, including a lock on said handle which blocks its movement when said sash is in an opened position.

* * * * *